United States Patent [19]

Sano

[11] 4,373,461

[45] Feb. 15, 1983

[54] SEWING MACHINE WITH A CYCLE PATTERN STITCHING DEVICE

[75] Inventor: Yasuro Sano, Hachioji, Japan

[73] Assignee: Janome Sewing Machine Co. Ltd., Tokyo, Japan

[21] Appl. No.: 177,460

[22] Filed: Aug. 11, 1980

[30] Foreign Application Priority Data

Aug. 16, 1979 [JP] Japan ..... 54-112054[U]

[51] Int. Cl.[3] ..... D05B 69/22

[52] U.S. Cl. ..... 112/274

[58] Field of Search ..... 112/274, 275, 158 A, 112/158 R, 158 B, 158 D, 220, 221

[56] References Cited

U.S. PATENT DOCUMENTS 4,083,316 4/1978 Kasuga ..... 112/274

4,246,858 1/1981 Ogawa ..... 112/158 A X

*Primary Examiner*—Peter P. Nerbun

*Attorney, Agent, or Firm*—Michael J. Striker

[57] ABSTRACT

A sewing machine comprises an upper shaft adapted in a known manner to reciprocate the needle of the sewing machine. A motor-driven pulley is freely turnable on the shaft and normally connected to the latter by a clutch. A stop cam having an engaging face is fixed to the shaft for rotation therewith and a stop lever is movable by a manually operated lever between an inoperative position located out of the path of rotation of the engaging face and an operating position in the path of the latter to stop rotation of the cam and therewith the shaft upon engagement of the stop lever with the engaging face. Elements cooperating with the stop cam cooperate with the clutch to disconnect the pulley from the shaft when the stop lever blocks rotation of the stop cam. Regulating elements cooperate with a cycle stitch control cam driven by the shaft with a predetermined speed to normally hold the stop lever in the inoperatives position and the stitch control cam moves the regulating elements in a direction to release the blocked lever after a predetermined number of revolutions of the shaft.

The sewing machine includes further a switch in circuit with the motor driving the pulley and elements cooperating with the manually operated lever for switching off the motor when the stop lever stops rotation of the stop cam, and manually adjustable cams for moving the regulating elements between an inoperative position spaced from the stitch control cam and an operative position engaging the latter.

3 Claims, 24 Drawing Figures

SEWING MACHINE WITH A CYCLE PATTERN STITCHING DEVICE

BRIEF DESCRIPTION OF THE INVENTION

The invention relates to a sewing machine, and more particularly relates to a cycle pattern stitching device for a sewing machine having an intermittent (one-by-one) stitching mechanism. According to the invention a cycle stitch control device is designed to cooperate with the intermittent stitching device of the sewing machine to produce patterns of cycle stitches in accordance with pattern cams to be selected. By cycle stitching we mean that the sewing machine is automatically stopped with the needle located at a predetermined position when a selected pattern has been produced up to a predetermined number of stitches.

For attaining this object, the invention substantially comprises cycle stitch control means, regulating means cooperating with the cycle stitch control means to regulate the intermittent stitching device, and manually operated switching means for selecting one of the stitching modes including the cycle stitching, the intermittent stitching and the normal continuous stitching.

The conventional cycle stitching device has required electrical structures to automatically stop the sewing machine after a predetermined number of stitches has been formed. As far as we know, a cycle stitching mechanism without electric structures has not been provided. This kind of device incorporated with electric structures is often complex in structure and costly in production, and moreover has produced considerable troubles in operation.

This invention has been provided to eliminate such defects and disadvantages of the prior art.

It is a primary object of the invention to provide a cycle stitching device which is composed of mechanical elements requiring no electric structures.

It is another object of the invention to provide a cycle stitching device which is compact in structure and positive in operation.

It is another object of the invention to provide a cycle stitch control device cooperating with an intermittent stitching device to automatically stop the sewing machine after a pattern is formed.

Many other features and advantages of the invention will be apparent from the following description of the prefered embodiments and reference to the attached drawings.

DETAILED DESCRIPTION OF THE INVENTION

Figure 4:
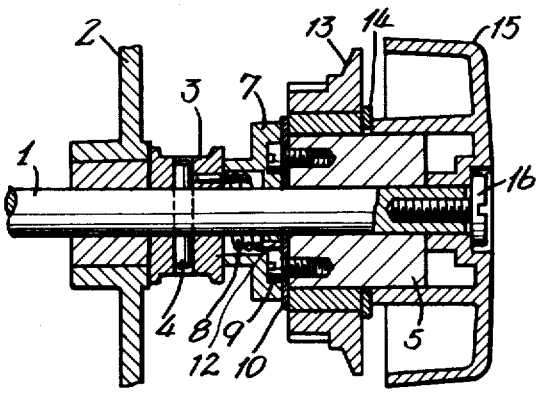
FIGS. 4 and 5 are sectional views of a clutch mechanism in which the sections respectively are taken along two planes normal to each other.
Figure 5:
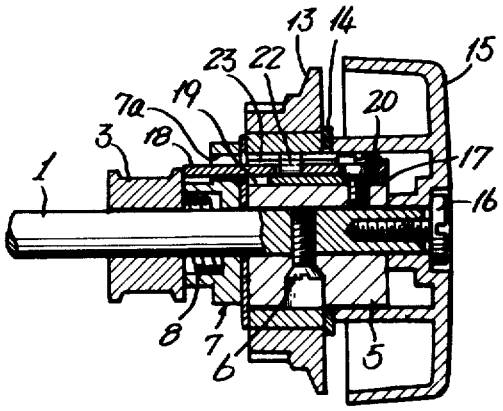
Figure 6:
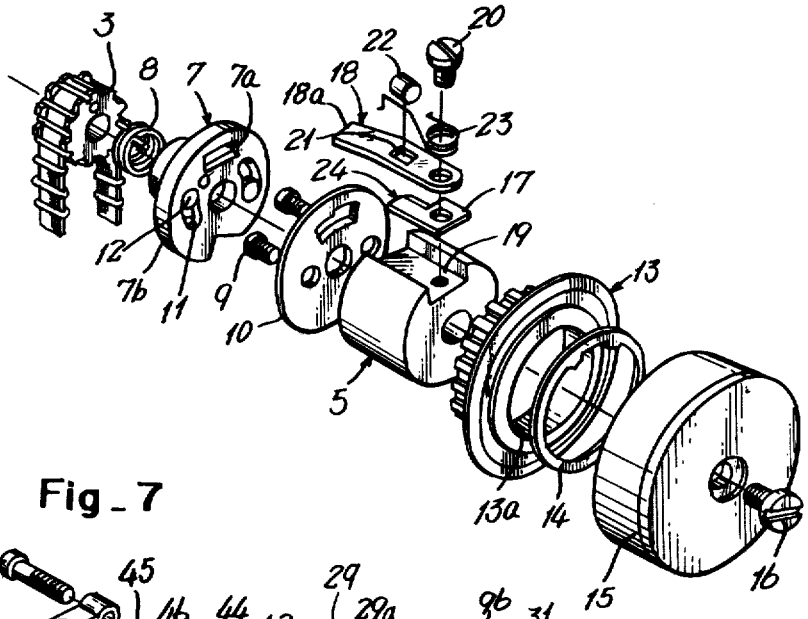
FIG. 6 is an exploded view of FIGS. 4 and 5.

In reference to FIGS. 1–5, the sewing machine has an upper shaft 1 rotatably mounted in a machine housing 2. A sprocket 3 is secured to the upper shaft 1 by means of a pin 4 for driving a lower shaft (not shown) through a timing belt as shown in FIG. 6. A bushing 5 is secured to the upper shaft 1 by means of a screw 6. A stop cam 7 is mounted on the upper shaft 1 between the sprocket 3 and the bushing 5, and is normally biased by a torsion spring 8 in the counterclockwise direction in FIG. 1. A pair of screws 9 are threaded into the bushing through a spacer 10, and each has a head respectively extending into two opposed arcuate slots 11 formed in the stop cam 7 as shown. Thus the heads of the screws 9 abut against the cushions 12 each provided at the ends of the respective slots 11 of the stop cam 7, thereby to normally stop the counterclockwise movement of the stop cam 7.

A pulley 13 is rotatably mounted on the bushing 5, and a knob 15 is mounted on the bushing 15 and is secured to the end of the upper shaft 1 by means of a screw 16 with a spacer 14 placed between the pulley 13 and the knob 15. As shown in FIG. 6, the bushing 5 is formed with an axially extended groove 19. A platelet 17 is secured to the botton of the groove 19 by a stepped screw 20, and a clutch lever 18 is turnably arranged on the platelet 17 by the stepped screw 20. The free end **18*a* of the clutch lever 18 is inserted into a slot 7*a* of the stop cam 7. As shown, the cluth lever 18 is normally biased in the counterclockwise direction by a torsion spring 23. The clutch lever 18 is formed with a rectangular hole 21 in which a roller 22 is placed. The roller 22 is normally placed on the higher part of a slope 24 of the platelet 17 and connecting the bushing 5 and the inner periphery 13*a* of the wheel 13, thereby to transmit the rotation of the pulley 13 to the upper shaft 1. Therefore, if the clutch lever 18 is turned in the clockwise direction against the action of the torsion spring 23, the roller is displaced from the higher part of the slope 24 to a lower part of the groove 19 in which the roller 22 is spaced from the inner periphery 13*a* of the pulley. In this case, the rotation of the pulley 13 is not transmitted to the upper shaft 1**.

Figure 1:
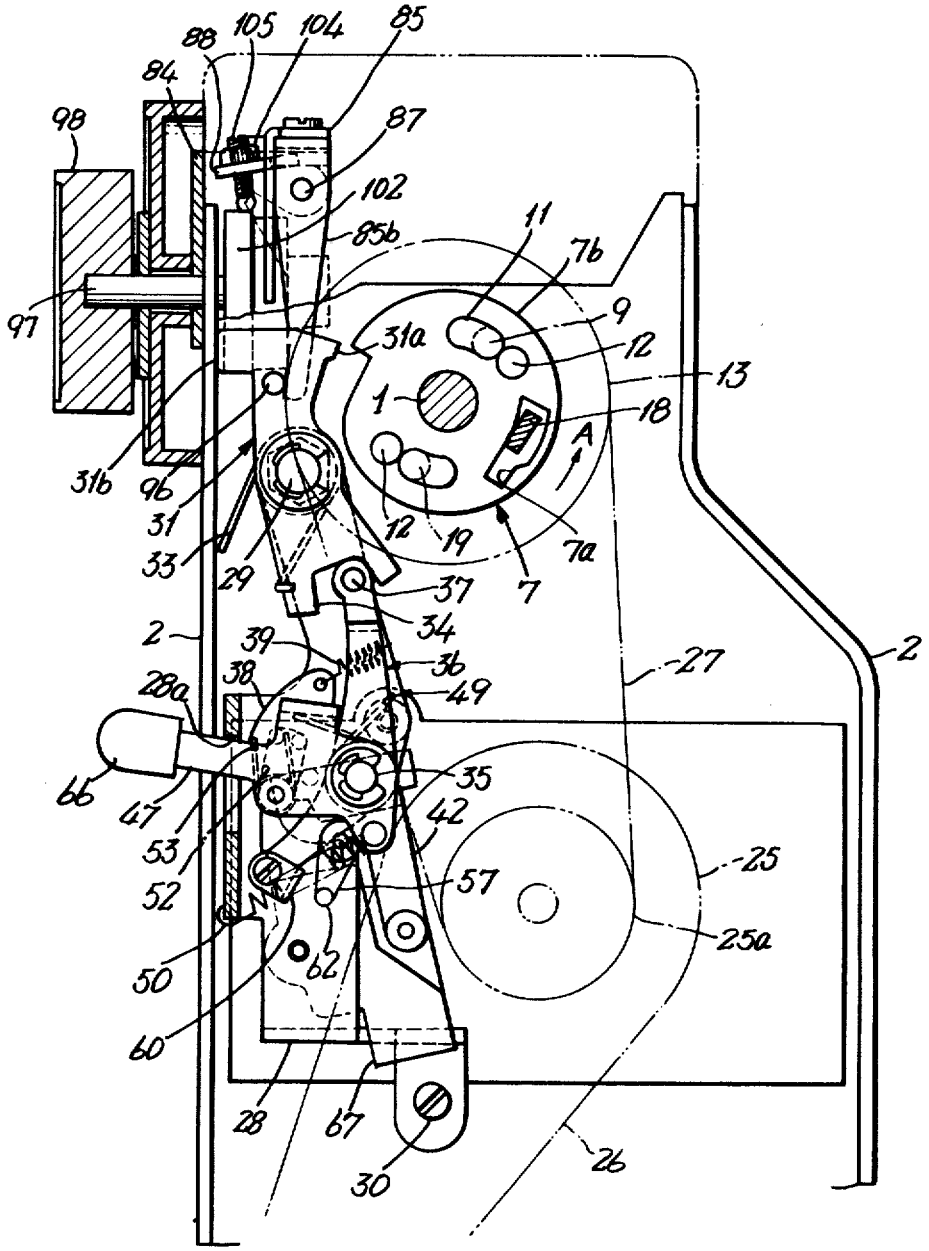
FIG. 1 is a side elevational view of the invention shown partly in section.
Figure 2:
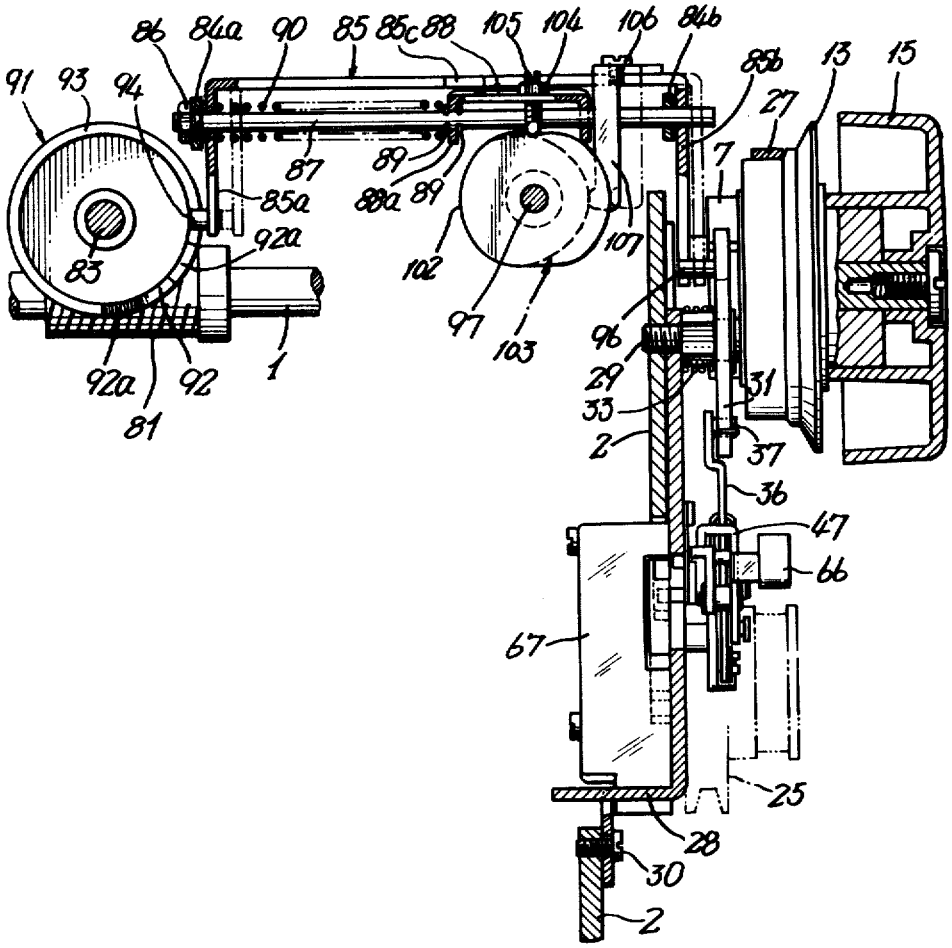
FIG. 2 is a front elevational view of the invention shown partly in section.
Figure 7:
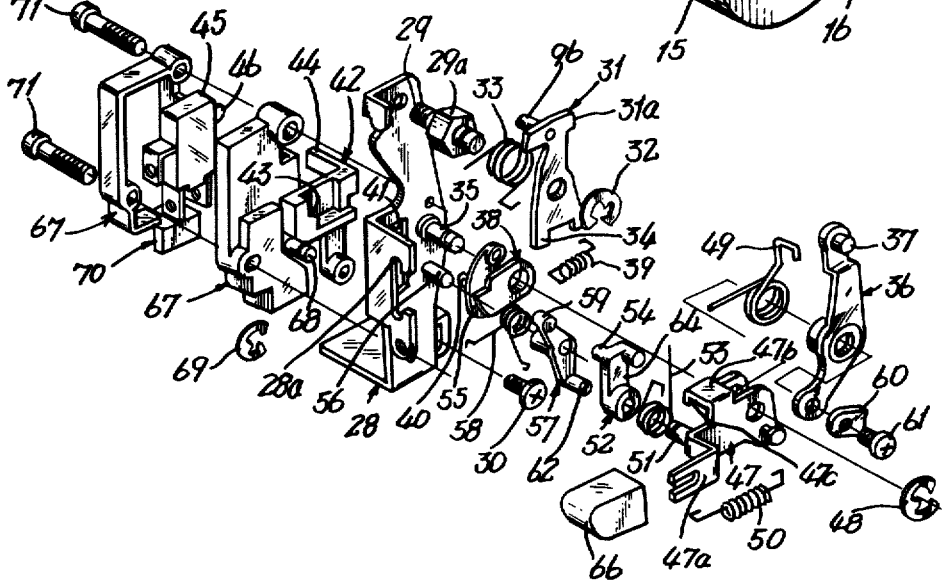
FIG. 7 is an exploded view of a stitch mode selecting part of the invention.

As shown in FIG. 1, an intermediate pulley 25 is provided. The pulley 25 is connected to a machine drive motor (not shown) by means of a belt 26. The pulley 25 is formed with a coaxial small pulley **25*a* which is connected to the pulley 13 by means of another belt 27, so that the driving power of the machine drive motor may be transmitted to the pulley 13. Thus the pulley 13 is rotated in the direction as indicated by an arrow A. As shown in FIGS. 1, 2 and 7, a bracket 28** for a machine stopping mechanism is secured to the machine housing 2 by means of upper and lower screws 29, 30. The screw 29 has a nut 29*a* mounted at the intermediate part thereof. A stop lever 31 is turnably mounted on the screw 29 on one side of the nut 29*a* and is prevented from axial displacement by a snap ring 32. The stop lever 31 is normally biased in the counterclockwise direction by a spring 33 (in FIGS. 1 and 7), and the upper end 31*a* of the stop lever 31 is normally located at a position spaced from the rotation path of the stop cam 7. The stop lever 31 is formed with a forked part 34 at the lower end thereof. An operating lever 36 is turnably mounted on a pin 35 provided on the bracket 28, and has a pin 37 secured to the free end thereof. The pin 37 is in engagement with the forked part 34 of the stop lever 31, so that the operating lever 36 may be operated to turn the stopper lever 31 relative to the stopper cam 7.

As shown in FIGS. 1, 7–9, a switch activating lever 38 is turnably mounted on the pin 35 of the bracket 28 and is normally biased in the clockwise direction by a tension spring 39. A pin 40 secured to the switch activating lever 38 is extended through a hole 41 of the bracket and is kept in engagement with a cam 43 of a turnably arranged switching lever 42 to locate the lateral projection 44 of the lever 42 at a position adjacent to an operating button 46 of a switch 45. Thus the switch 45 is normally inoperative. A manually accessible operating lever 47 is turnably mounted on the free end of the pin 35 of the bracket 28 and is prevented from displacement axially of the pin 35 by a washer 48. The operating lever 47 and the other operating lever 36 are connected to each other by a torsion spring 49 which normally biases the former in the clockwise direction and the latter in the counterclockwise direction. The operating lever 36 is normally pressed against an abutment part 47*b* of the operating lever 47 and thus the two levers are operated together. On the other hand, the operating lever 47 is biased in the clockwise direction by a tension spring 50, and the part 47*a* thereof is pressed against an abutment 28*a* of the bracket 28. Thus the operating lever 47 and the other lever 36 are normally positioned as shown in FIG. 1, in which the pin 37 of the lever 36 is idle in the forked part 34 of the stop lever 31.

Figure 8:
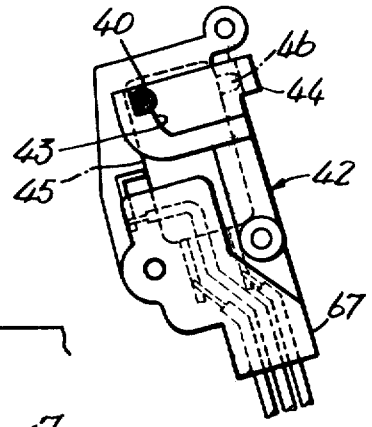
FIGS. 8, 8A–8D are side elevational views of a switch of the invention shown in different operation positions.
Figure 9:
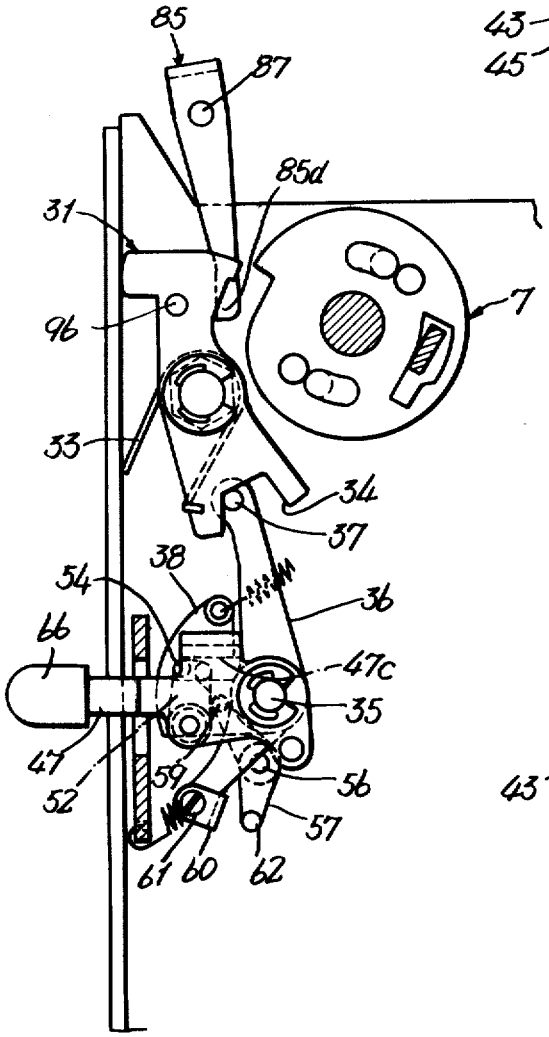
FIGS. 9–14 are side elevational views of the stitch mode selecting part of the invention shown in different operation positions.
Figure 8A:
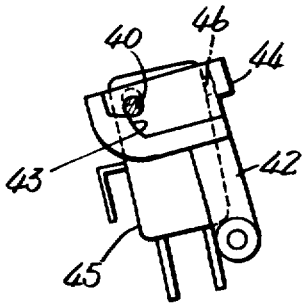

The operating lever 47 has a pin 51 secured thereto. A pawl 52 is turnably mounted on the pin 51 and is normally biased in the clockwise direction by a spring 53. The pawl 52 has a projection 54 which is normally pressed against an abutment 47*c* of the operating lever 47, and is also in engagement with a cam 55 of the switch activating lever 38. The bracket 28 has another pin 56 secured thereto on which a releasing pawl 57 is turnably mounted and is normally biased in the clockwise direction by a spring 58. When the operating lever 47 is brought to an medium position as shown in FIG. 9, the upper end 59 of the releasing pawl 57 is pressed against the operating lever 36. The operating lever 36 has an adjusting element 60 secured to the lower end thereof by a screw 61. The adjusting element 60 and the lower end 62 of the releasing pawl 57 are spaced from each other when the operating lever 47 is in the upper inoperative position as shown in FIG. 1 or in the medium position as shown in FIG. 9. However, in the position of FIG. 9, the pawl 52 is operated to press, by way of the switch activating lever 38, the projected end 44 of the switching lever 42 against the button 46 of the switch 45 as shown in FIG. 8A. Thus the switch 45 becomes operative.

Figure 10:
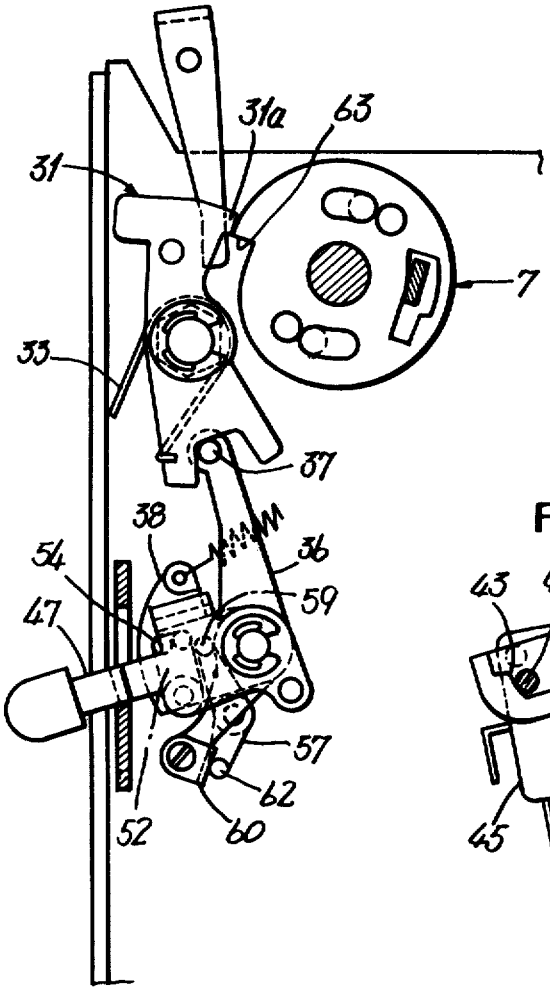
Figure 8B:
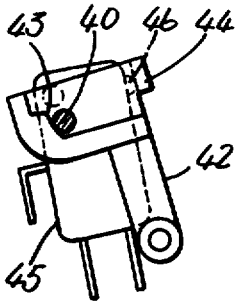
Figure 11:
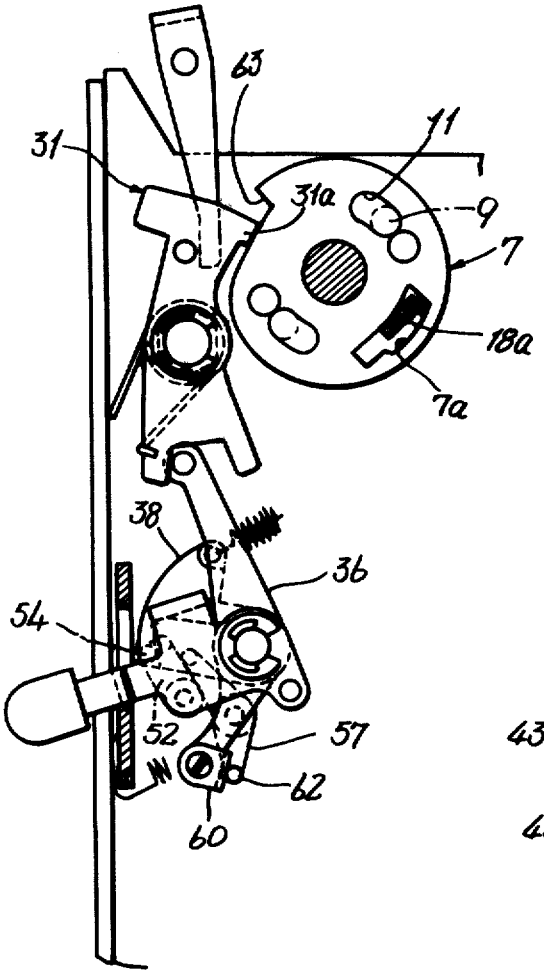
Figure 8C:
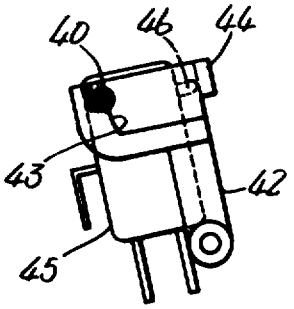

As shown in FIG. 10, if the operating lever 47 is brought to the lower position, the other operating lever 36 is operated to turn the stop lever 31 in the clockwise direction against the action of the spring 33 toward the rotation path of the stop cam 7 which is formed with an abutment 63. Simultaneously the adjusting element 60 at the end of the operating lever engages the lower end 62 of the releasing pawl 57, and the upper end 59 of the releasing pawl 57 comes to engage the side 64 of the pawl 52 as will be understood from FIG. 7. As the sewing machine is driven and the abutment 63 of the stop cam 7 comes to be blocked by the end 31*a* of the stop lever 31, as shown in FIG. 11, the adjusting element 60 turns the releasing pawl 57 in the counterclockwise direction, thereby to disengage the projection 54 of the pawl 52 from the cam 55 of the switch activating lever 38. The switch activating lever 38, therefore, releases the switching lever 42, and thus the switching lever 42 is disengaged from the button 46 of the switch 45 as shown in FIG. 8C, and the switch is opened to be inoperative.

In reference to FIG. 7, an operating knob 66 is secured to the free end of the operating lever 47. The switch 45 is contained in a switch case composed of a pair of housing members 67 and a cover 70, which are secured to the bracket 28 by a pair of screws 71.

The operation of the foregoing mechanism is as follows; If the operating lever 47 is displaced to the upper inoperative position as shown in FIG. 1, the sewing machine is driven with a desired speed in the range from a high speed to a low speed by operation of an operator-controlled switch (not shown).

If the operating lever 47 is displaced to the medium position as shown in FIG. 9 immediately after the operator-controlled switch is released or during the time the operator-controlled switch is operated, the pawl 52 turns the switch activating lever 38 in the counterclockwise direction against the action of the spring 39. As the result, the pin 40 of the switch activating lever 38 which is in engagement with the cam 43 of the switching lever 42, is displaced from a higher position as shown in FIG. 8 to a lower position as shown in FIG. 8A. Thus the pin 40 turns the switching lever 42 in the counterclockwise direction to press the same lever against the button 46 of the switch, and then the switch becomes operative. In this condition, the sewing machine is designed to rotate at a lower speed irrespectively of operation of the operator-controlled switch. In this case, the operating lever 36 has no influence on the stop lever 31.

Figure 12:
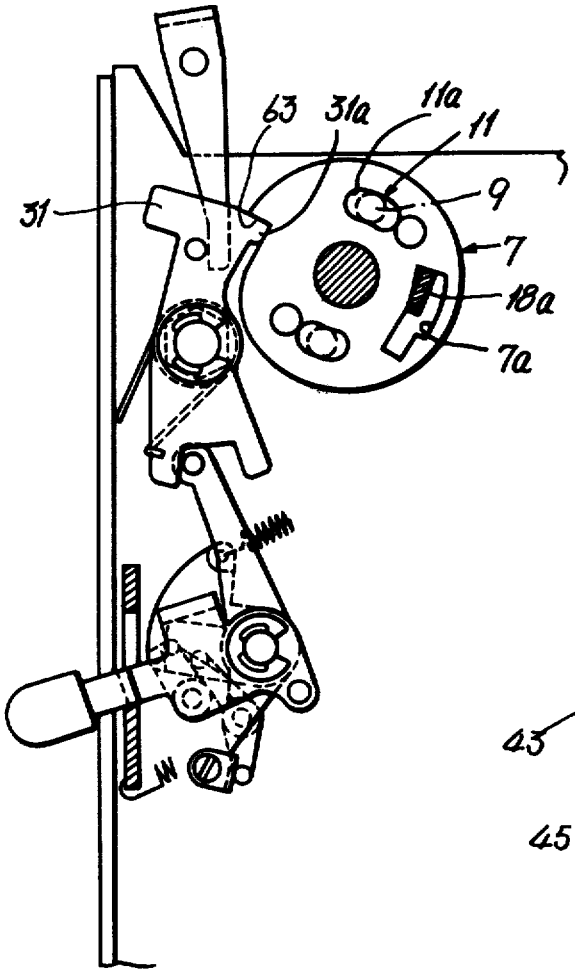
Figure 8D:
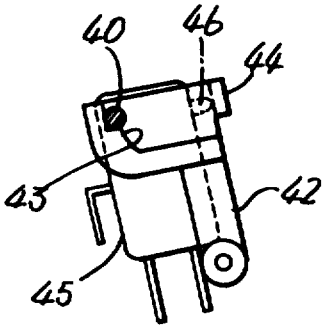

If the operating lever 47 is displaced to the lower position as shown in FIG. 10, the operating lever 36 turns the stop lever 31 in the clockwise direction against the action of the torsion spring 33. The end 31*a* of the stop lever 31 comes to engage the outer periphery of the abutment part 63 of the stop cam 7, as shown, if the needle is not just at the upper dead point thereof. In this case, the pin 40 of the switch activating lever 38 further comes down as shown in FIG. 8B, and thus the switch 45 remains to be operated. Simultaneously the adjusting element 60 at the lower end of the operating lever 36 will engage the lower end 62 of the releasing pawl 57. When the sewing machine makes one rotation and the end 31*a* of the stop lever 31 engages the abutment 63 of the stop cam 7 as shown in FIGS. 11 and 12, the operating lever 36 further turns the stop lever 31 in the clockwise direction by a force stored in the torsion spring 49 (FIG. 1). Therefore, the adjusting element 60 at the lower end of the operating lever 36 turns the releasing lever 57 in the counterclockwise direction. As the result, the releasing pawl 57 turns the pawl 52 in the counterclockwise direction to release the projection 54 from the cam 55 of the switch activating lever 38. Then the switch activating lever 38 is turned in the clockwise direction by the tension spring 39, and the pin 40 is, therefore, displaced, relative to the cam 43 of the switching lever 42, to the upper inoperative position as shown in FIGS. 8C and 8D. Then the switching lever 42 is turned in the clockwise direction by a spring (not shown), and therefore, the lateral projection 44 of the switching lever 42 is displaced to a position spaced from the switch 45. Thus the switch 45 becomes inoperative, and the electric current to the machine drive motor is blocked. The upper shaft 1 of sewing machine is, however, rotated by its own inertia, even when the stop cam 7 is blocked by the stop lever 31 as shown in FIG. 12. Namely the upper shaft 1 is rotated against the action of the cushion spring 8 connecting the stop cam 7 and the upper shaft 1 and biased in one direction due to the engagement of the stop cam 7 and the stop lever 31 as shown in FIGS. 4 and 5, and the inertia of the upper shaft 1 is absorbed by the spring 8 until the stop screws 9 abut against the cushions 12 respectively which are provided at the respective ends of the slots 11 of the stop cam 7 as shown in FIG. 6. At the same time, the clutch lever 18 (FIG. 6) is displaced in the clockwise direction against the action of the spring 23, and the roller 22 in the groove 19 of the bushing 5 is displaced from the position, in which it connects the upper shaft 1 to the pulley 13, to the position in which it disconnect the upper shaft 1 from the pulley 13. Thus the sewing machine is stopped with a predetermined angular position of the upper shaft 1, that is, with a predetermined position of the needle.

Then if the operating lever 47 is released, the lever is returned, by the action of the torsion spring 49, to the initial inoperative position, and thus the relating elements are all returned to the initial position as shown in FIG. 1. If the operating lever 47 is displaced to the medium position again, the sewing machine is driven at a low speed. On the other hand, if the operating lever 47 is repeatedly displaced between the upper inoperative position and the lower operative position, the sewing machine is intermittingly driven at a low speed to produce one-by-one stitches or basting stitches.

The above described mechanism can be utilized to produce the patterns of cycle stitches together with an additional mechanism.

Figure 3:
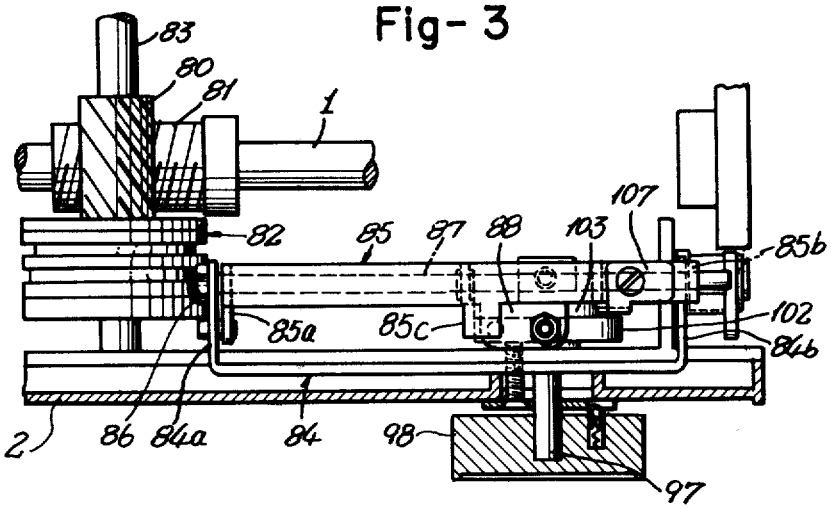
FIG. 3 is a plan view of the invention with some parts eliminated.

In reference to FIGS. 1, 2 and 3, the upper shaft 1 has a worm 81 secured thereto. The worm 81 is in mesh with another worm 80 secured to a transverse shaft 83, so that the transverse shaft 83 may be rotated by the upper drive shaft at a reduced speed. A group of pattern cams 82 are secured to the transverse shaft 83 for rotation therewith. An elongated U shaped frame 84 is secured to the machine housing 2 carrying a mounting shaft 87 secured to the U shaped frame by a nut 86 between the two arms **84*a*, 84*b* thereof as shown in FIG. 3. An elongated U shaped lever 85 is turnably mounted on the shaft 87. The lever 85 is, at one end, provided with a depending follower arm 85*a* carrying a pin 84 at the lower end thereof, and is, at the other end, provided with another depending arm 85*b* which is located adjacent to the stop lever 31 to cooperate with a pin secured to the latter. A U shaped element 88 is turnably mounted on the shaft 87 between the two arms 85*a*, 85*b* of the U shaped lever 85. A part of the U shaped element 88 is located just below a projection 85*c* of the lever 85 so as to cooperate with the latter as will be mentioned. The U shaped element 88 is prevented from movement axially of the shaft 87 by a pair of washers 89 as shown. A spring 90 is provided between one end of the U shaped element 88 and the arm 85*a* of the U shaped lever 85** to normally bias the latter in the leftward direction.

Figure 15:
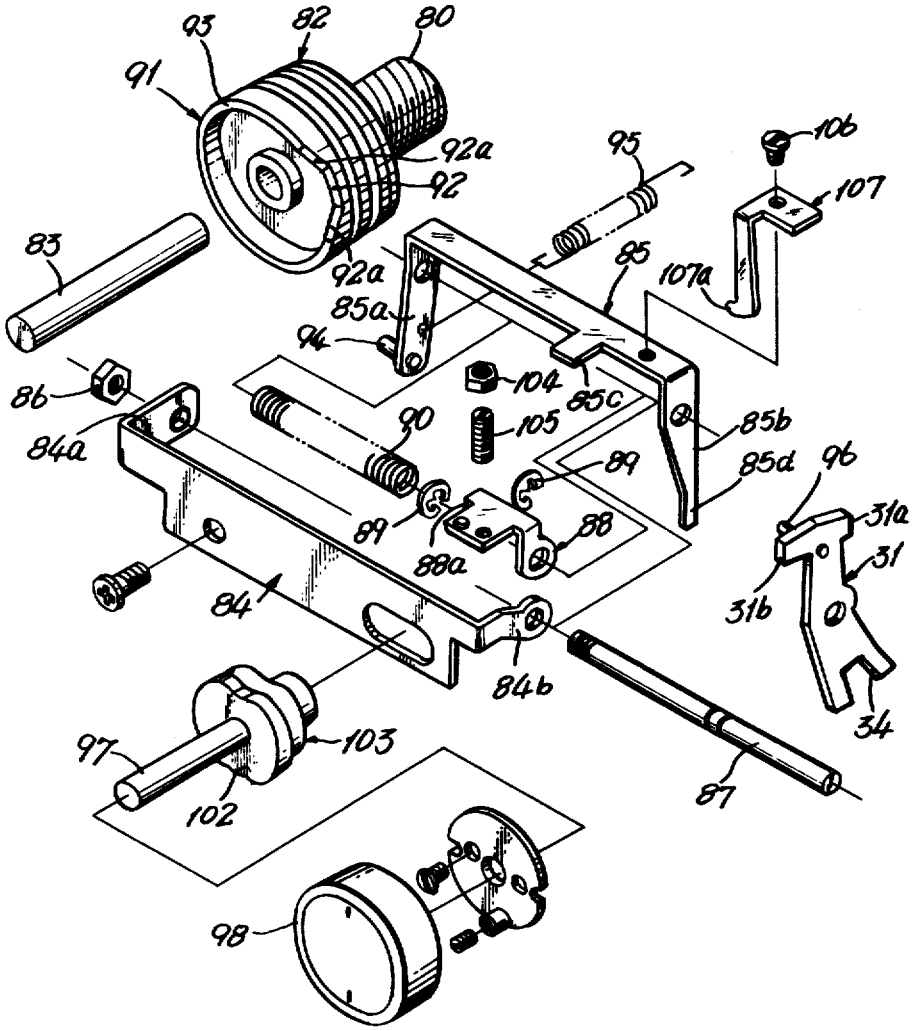
FIG. 15 is an exploded view of a cycle stitch control mechanism of the invention.

A cycle stitch control cam 91 is provided on the transverse shaft 83 at the forward end of the pattern cam group 82. The cycle stitch control cam 91 is, at the front side thereof, formed with a groove 92 extending radially and circumferentially as shown in FIG. 2. On both sides of the groove 92, slopes **92*a*, 92*a* are provided, each extending from the botton of the groove 92 up to the front face of the control cam 91 to guide the pin 94 of the U shaped lever 85 as will be mentioned. The U shaped lever 85 is normally biased in the counterclockwise direction as viewed in FIG. 13 by a spring 95 as shown in FIG. 15, so that the pin 94 of the lever 85 may be normally pressed against the front face of the control cam 91 as shown in FIG. 2, and so that the arm 85*b* of the lever 85 may be located at a position adjacent to the pin 96 on the stopper lever 31 as shown in FIG. 13**.

A transverse control shaft 97 is rotatably mounted on the machine housing 2 as shown in FIGS. 1 and 2. An operating dial 98 is secured to the forward end of the control shaft 97 which projects out of the machine housing 2. Marks for the intermittent stitches and the cycle stitches are provided on the front face of the dial 98 in the positions diametrically opposite to each other in relation to a set mark provided on the machine housing as well known, though these marks are not shown. A selecting cam 103 and an operating cam 102 are secured to the control shaft 97. A follower 107 is secured to the U shaped lever 85 by a screw 106, and is pressed against the selecting cam 103 by the action of the spring 90. On the other hand, a follower pin 105 is secured to the U shaped element 88 by a nut 104, and is pressed against the operating cam 102 by a spring (not shown) which normally biases the U shaped element 88 in the counterclockwise direction as viewed in FIG. 1.

The cycle stitching mechanism is operated as follows; FIGS. 2 and 13 show that the cycle stitching has been selected. Namely, the U shaped lever 85 has been displaced from the position shown by the imaginery line to the position shown by the solid line in which the pin 94 is pressed against the front face of the control cam 91 at the circumferential effective region 93 thereof. This displacement of the U shaped lever 85 is carried out by manual operation of the dial 98. Namely, the operating cam 102 turns the U shaped element 88 in the clockwise direction in FIG. 1, thereby to turn the U shaped lever 85 in the clockwise direction to displace the pin 94 in a plane forwardly of the front face of the control cam 91. Simultaneously the U shaped lever 85 is displaced in the leftward direction in accordance to the configuration of the selecting cam 103 due to the spring 90 until the pin comes to the effective range 93 of the control cam 91. Then the U shaped element 88 is allowed to turn in the opposite direction by the configuration of the operating cam 102. Thus the pin 94 is pressed against the control cam 91 as shown in FIG. 2.

Figure 13:
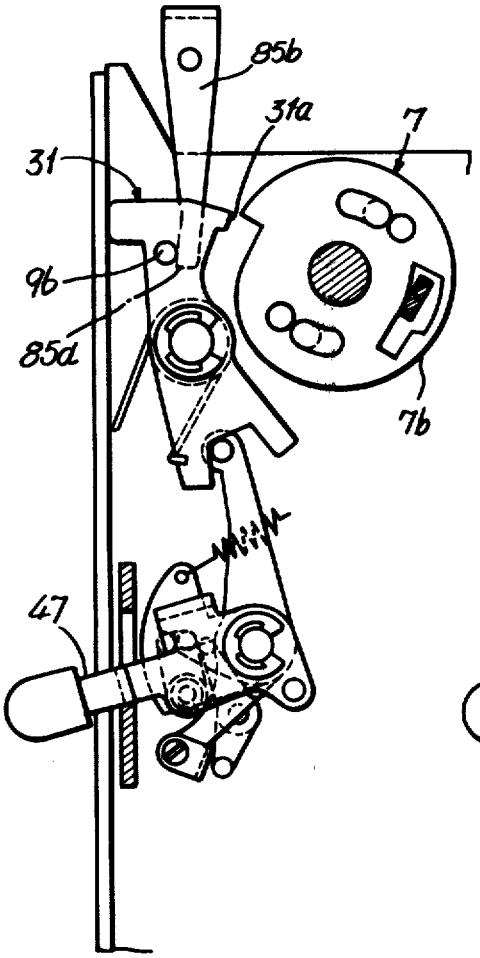
Figure 14:
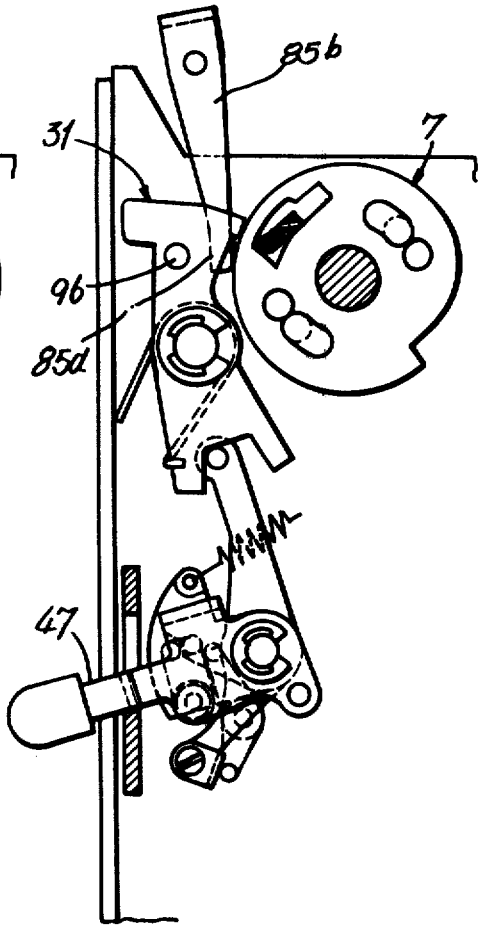

In this condition, if the operating lever 47 is displaced to the lower set position as shown in FIG. 13, the stop lever 31 remains in the inoperative position because the clockwise movement of the stop lever 31 is prevented by the lower end 85*d* of the depending arm 85*b* of the U shaped lever 85. When the upper shaft 1 makes a predetermined number of rotations, for example, if the group of pattern cams 82 makes one complete rotation while the upper shaft 1 makes one complete rotation, the pin 94 of the U shaped lever 85 is dropped into the groove 92 of the control cam 91. Then the U shaped lever 85 is turned in the counterclockwise direction, and allows the stop lever 31 to turn in the clockwise direction as shown in FIG. 11. Then when the rotation of the stop cam 7 is blocked by the stop lever 31 as shown in FIG. 12, the sewing machine is stopped with the needle located at a predetermined position in the manner as aforementioned.

Then, if the operating lever 47 is displaced again in the upper inoperative position, the stop lever 31 is returned to the inoperative position spaced from the rotation path of the stop cam 7. Therefore, if the sewing machine is driven with a repeated operation of the operating lever 47 between the upper inoperative position and the lower operative position, a pattern of cycle stitches is repeatedly produced, and the pattern may be varied in dependence upon a selected one of the pattern cams 82.

Figure 16:
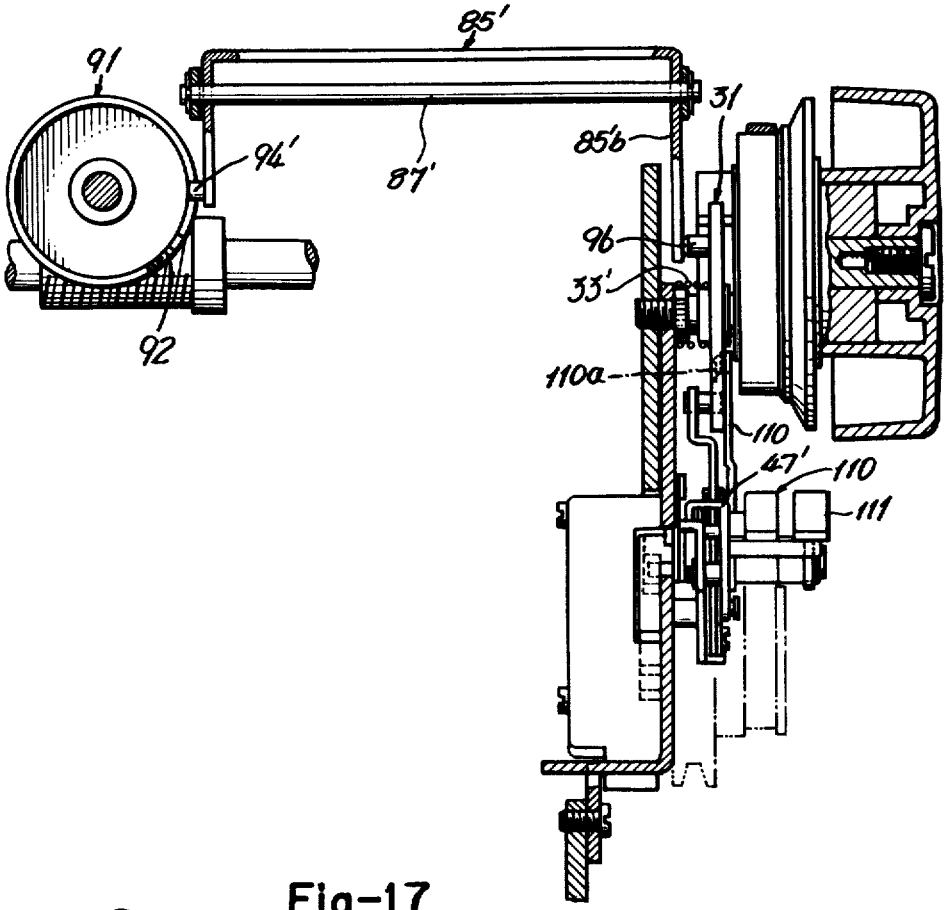
FIG. 16 is a front elevational view showing a second embodiment of the invention.
Figure 17:
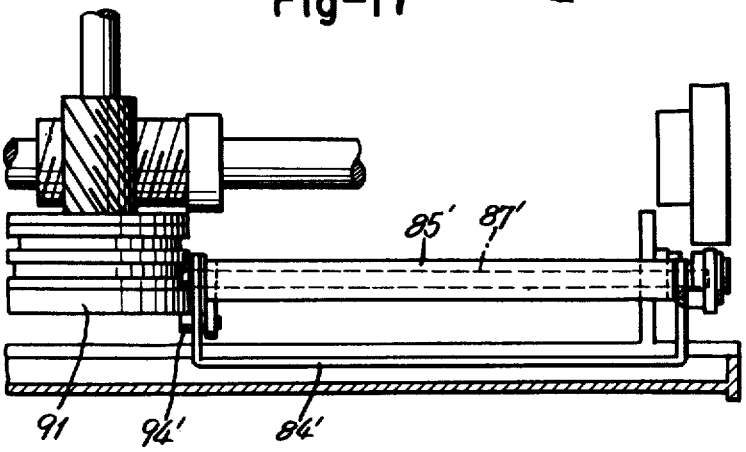
FIG. 17 is a plan view showing part of FIG. 16.
Figure 18:
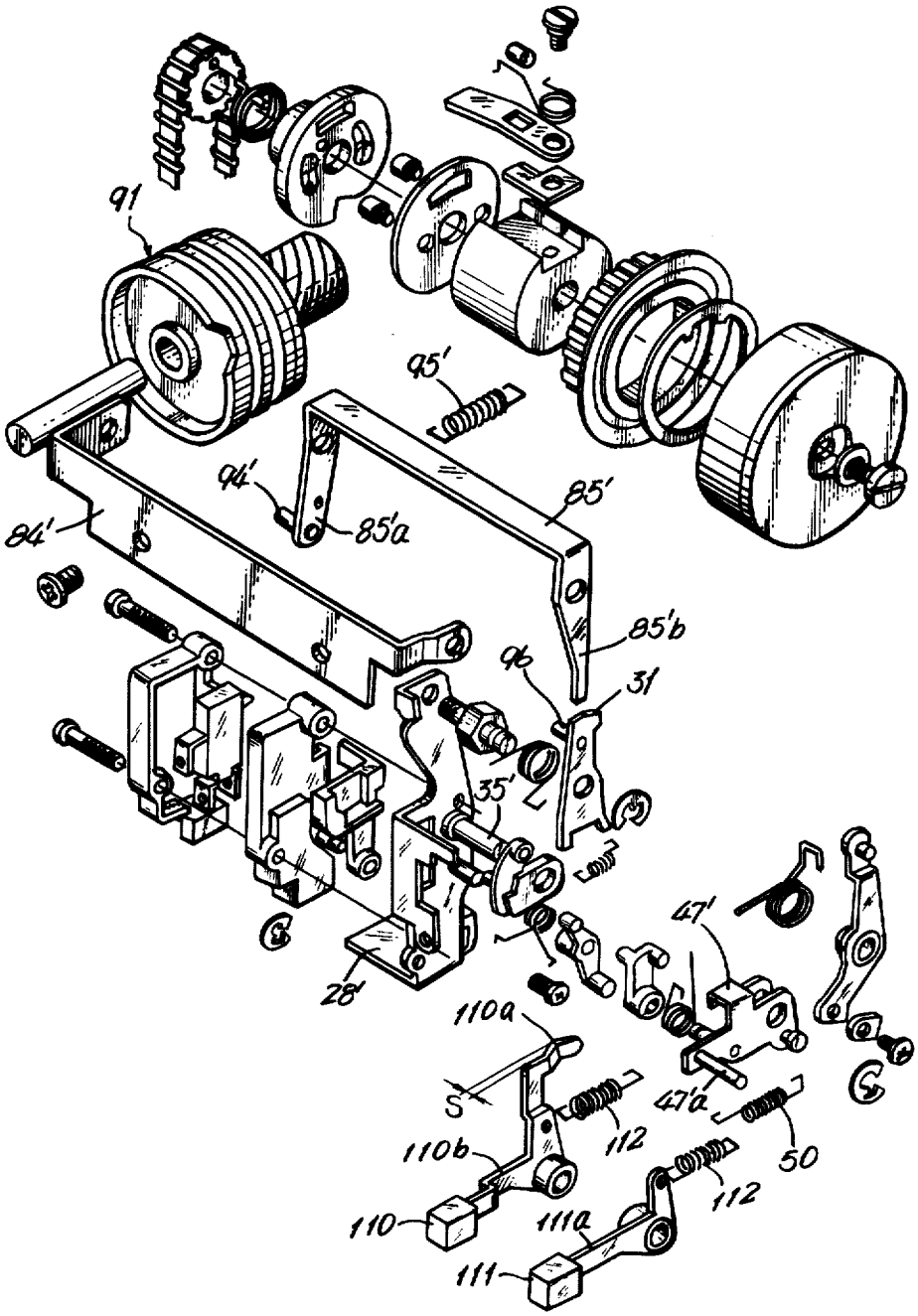
FIG. 18 is an exploded view of the second embodiment of the invention.
Figure 19:
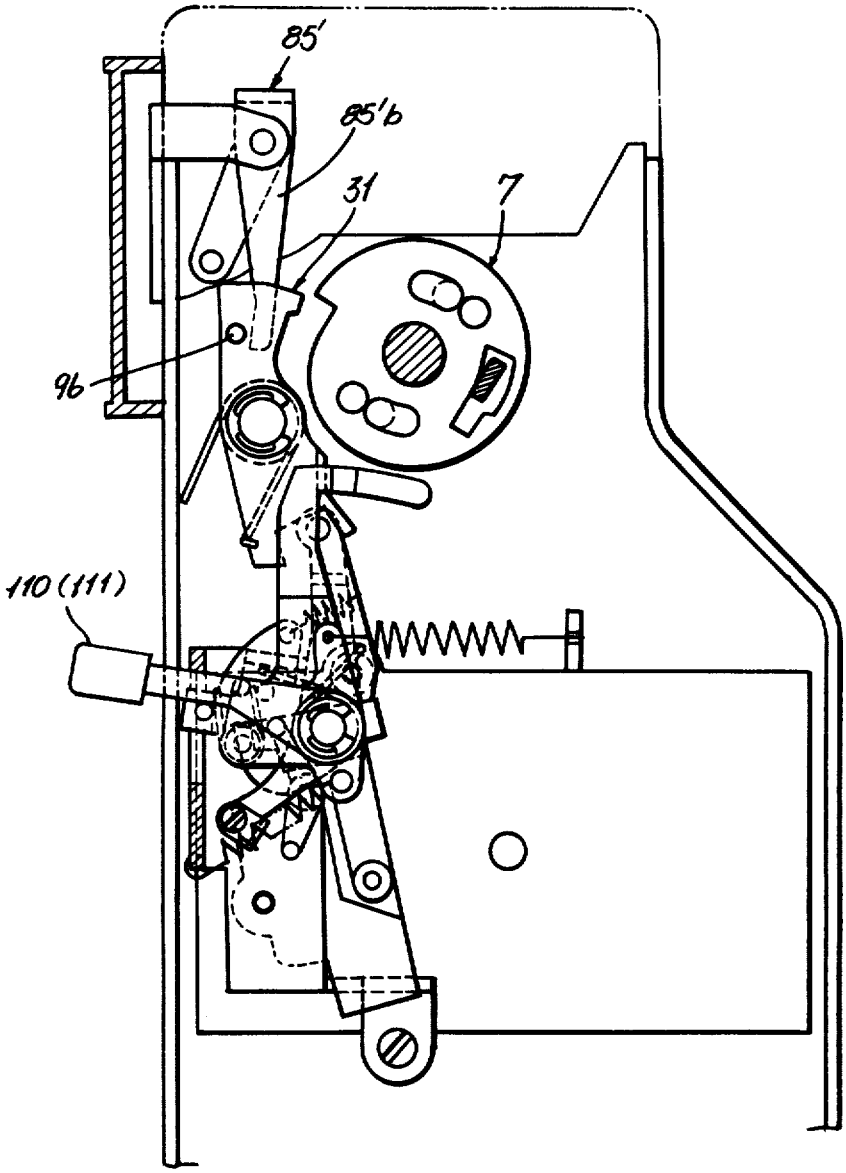
FIGS. 19 and 20 are side views of the stitch mode selecting device of the second embodiment.

FIGS. 16–20 show another embodiment of the invention which is different from the first embodiment in the following points; According to the other embodiment, a cycle stitch operating lever 110 and an intermittent stitch operating lever 111 are turnably mounted on the support pin 35' of the bracket 28'. These operating levers 110, 111 are normally biased in the clockwise direction by springs 112 respectively. The cycle stitch operating lever 110 has a cam 110*a* with a cam lift S formed at the inner end thereof, which is to be pressed against the right side of the stopper lever 31 as shown in FIG. 16. A pin 47'*a* of the operating lever 47' is pressed against the underside of the arms 110*b* and 111*a* of the respective levers 110, 111 by a tension spring 50. As shown in FIG. 16, the U shaped lever 85' is prevented from displacement axially of the support shaft 87', and the pin 94' are usually pressed against the front face of the control cam 91, and the depending arm 85'*b* are located at a position spaced from the pin 96 of the stopper lever 96. The stopper lever 31 is laterally displacable against the action of the spring 33'.

Figure 20:
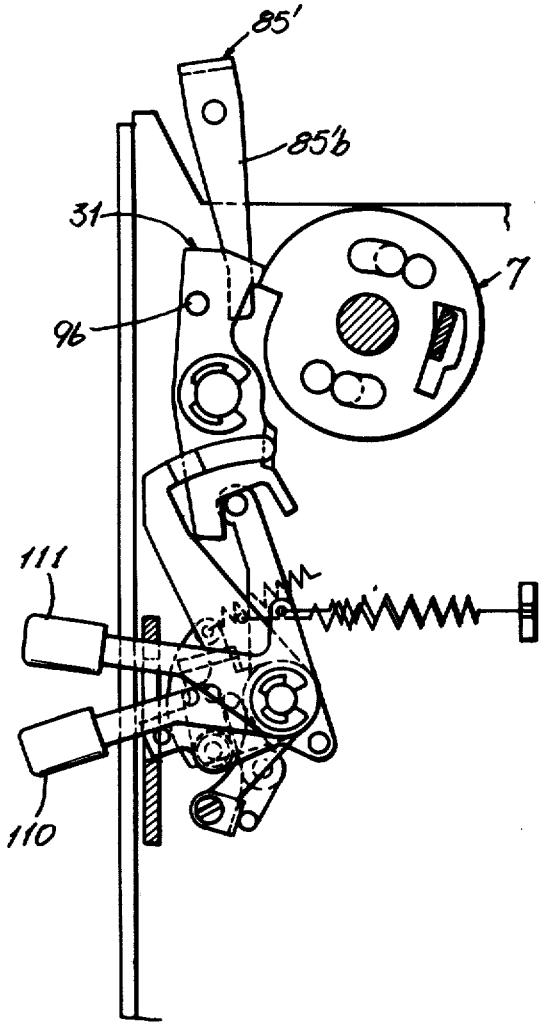

If the cycle stitch operating lever 110 is displaced from the upper inoperative position to the lower operative position, the operating lever 47' is also displaced to the lower operative position. Simultaneously the stopper lever 31 is displaced in the leftward direction against the action of the spring 33' by the cam lift 110*a* of the lever 110. Therefore, the stopper lever 31 is prevented from turning movement in the clockwise direction, by the depending arm 85'*b*, and remains to be in the inoperative position in the same manner as shown in FIG. 13. Then, if the sewing machine is driven and the control cam 91 together with the pattern cams 82 are rotated, and when the pin 94' of the U shaped lever 85' is dropped into the groove 92 of the control cam 91, then the U shaped lever 85' is turned in the clockwise direction and the stopper lever 31 is released to rotate in the clockwise direction toward the rotation path of the stopper cam 7 as shown in FIG. 20. Thus the cycle stitching can be repeatedly carried out by repeated operation of the cycle stitch operating lever 110 between the upper inoperative position and the lower operative position.

Figure 21:
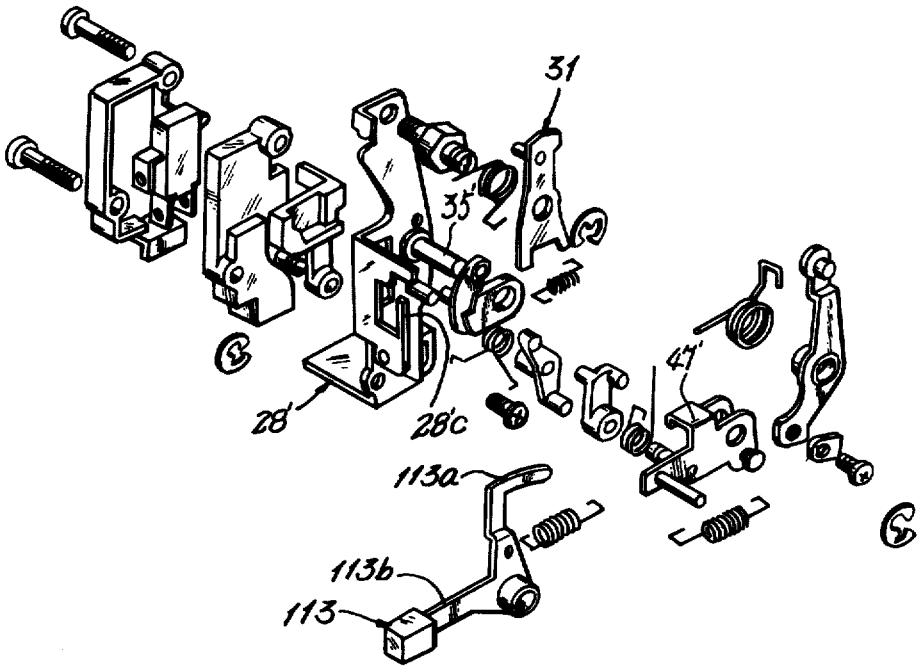
FIG. 21 is an exploded view of a third embodiment of the invention.

FIG. 21 shows still another embodiment of the invention, in which a single operating lever 113 is employed in place of the cycle stitch operating lever 110 and the intermittent stitch operating lever 111 of the second embodiment, and the bracket 28' is formed with an upstanding projection 28'*c*. The operating lever 113 is laterally displaceable on the support pin 35' of the bracket 28'. Thus, if the arm 113*b* of the operating lever 113 is displaced to the left side of the upstanding projection 28'*c* of the bracket 28', the free end part 113*a* of the lever 113 displaces the stopper lever 31 (in FIG. 16) in the leftward direction against the action of the spring 33' in the same manner as in the second embodiment. Then, if the operating lever 113 is displaced from the upper inoperative position to the lower operative position, the operating lever 47' is also displaced in the same manner as in the second embodiment. On the other hand, if the operating lever 113 is displaced to the right side of the upstanding projection 28'*c*, the U shape lever 85' becomes inoperative. Then, if the operating lever 113 is displaced to the lower operative position, the operating lever 47' is also displaced to the lower operative position. Thus the intermittent stitching mode is selected.

We claim:

1. A sewing machine, comprising a housing; an upper shaft turnably mounted in said housing and adapted to reciprocate a needle penetrating a fabric to be sewn; a pulley mounted on said upper shaft freely rotatable relative thereto; means adapted to be driven by a motor for rotating said pulley; clutch means normally connecting said upper shaft to transmit rotation of said pulley to said upper shaft; stop means mounted on said upper shaft for rotation therewith; blocking means displaceable between an inoperative position in which it is spaced from the path of rotation of said stop means and an operative position located in said path to block rotation of said stop means; means cooperating with said stop means and operating said clutch means to disconnect said upper shaft from said pulley when said blocking means blocks rotation of said stop means; cycle stitch control means rotated by said upper shaft at a predetermined speed; regulating means cooperating with said control means while holding said blocking means in said inoperative position; and manually operated means operated to a predetermined position to constantly bias said blocking means toward the path of rotation of said stop means against the action of said regulating means holding the blocking means in the inoperative position, said control means operating said regulating means in one direction to release said blocking means after a predetermined number of revolutions of said upper shaft.

2. A sewing machine as defined in claim 1, and including means operated in association with said blocking means released to move into the path of rotation of said stop means to thereby switch off the motor of the means for rotating the pulley.

3. A sewing machine as defined in claim 1, and including manually adjustable means for moving said regulating means between an inoperative position spaced from said control means and an operative position cooperating with said control means.

* * * * *